US005581340A

United States Patent [19]

Hayashi et al.

[11] Patent Number: 5,581,340

[45] Date of Patent: Dec. 3, 1996

[54] IMAGE-FORMING APPARATUS WITH A FIXING DEVICE FOR FIXING A TONER IMAGE ON A SHEET-LIKE MATERIAL

[75] Inventors: Masao Hayashi, Kanagawa-ken; Takayuki Ozawa, Tokyo; Koji Kagaya, Kanagawa-ken, all of Japan

[73] Assignee: Kabushiki Kaisha Toshiba, Kawasaki, Japan

[21] Appl. No.: 283,896

[22] Filed: Aug. 3, 1994

[30] Foreign Application Priority Data

Sep. 21, 1993 [JP] Japan ..... 5-234984

[51] Int. Cl.[6] ..... G03G 15/20

[52] U.S. Cl. ..... 355/285; 219/216; 355/282; 355/295; 492/53

[58] Field of Search ..... 355/285, 282, 355/289, 290, 295; 219/216, 469–471; 428/451, 219; 492/53, 56

[56] References Cited

U.S. PATENT DOCUMENTS

| | | | |
|---|---|---|---|
| 3,912,901 | 10/1975 | Strella et al. | 219/216 |
| 4,812,873 | 3/1989 | Inagaki et al. | 219/216 |
| 4,842,944 | 6/1989 | Kuge et al. | 428/451 |
| 4,985,733 | 1/1991 | Kurotori et al. | 355/282 |
| 5,289,246 | 2/1994 | Menjo | 355/285 |
| 5,289,247 | 2/1994 | Takano et al. | 355/285 |
| 5,327,202 | 7/1994 | Nami et al. | 355/282 |
| 5,331,385 | 7/1994 | Ohtsuka et al. | 355/290 |

*Primary Examiner*—Thu Anh Dang
*Attorney, Agent, or Firm*—Foley & Lardner

[57] ABSTRACT

An image-forming apparatus for forming an image on a sheet-like material, having an image-forming unit for forming a toner image on the sheet-like material, and a heated roller for heating the sheet-like material with the toner image. The heated roller includes a surface layer having a heat-shrunk fluorine resin. A pressure roller is arranged in rolling contact with the heated roller, for pressing the sheet-like material against the heated roller. A member for providing at least one of the following conditions: a) temperature at the surface of the heated roller of at least 200° C.; b) a pressure between the heated roller and the pressure roller of at least about 72.5 N; c) a hardness of the surface of the pressure roller of at least about 40° (ASKER-C system); and d) an elastic surface layer on the pressure roller having a thickness of at most about 50 μm and which comprises a fluorine resin.

19 Claims, 10 Drawing Sheets

FIG. 5

| | | | SURFACE TEMPERATURE | | | | | |
|---|---|---|---|---|---|---|---|---|
| | | | 190 C | | | | | |
| | | | THICKNESS OF SURFACE LAYER | | | | | |
| | | | 50 um | | | 70 um | | |
| | | | KINDS OF PAPER SHEET | | | | | |
| PRESSURE (N) | | HARDNESS OF PRESS ROLLLER (ASKER-C SYSTEM) | 20lb PAPER SHEET | 127 g/m PAPER SHEET | ENVE-LOPE | 20lb PAPER SHEET | 127 g/m PAPER SHEET | ENVE-LOPE |
| 54.9 N | | 40° | 50% | 64% | 56% | 75% | 59% | 50% |
| | | 50° | 43% | 56% | 52% | 50% | 50% | 55% |
| | | 52° | 43% | 53% | 63% | 50% | 47% | 60% |
| 72.5 N | | 40° | 73% | 76% | 87% | 77% | 81% | 60% |
| | | 50° | 80% | 75% | 76% | 90% | 76% | 59% |
| | | 52° | 78% | 67% | 66% | 51% | 66% | 78% |
| 81.3 N | | 40° | 93% | 81% | 81% | 93% | 73% | 54% |
| | | 50° | 81% | 80% | 85% | 77% | 70% | 84% |
| | | 52° | 71% | 71% | 84% | 67% | 66% | 62% |

FIG. 6

| PRESSURE (N) | HARDNESS OF PRESS ROLLLER (ASKER-C SYSTEM) | SURFACE TEMPERATURE 200 C | | | | | |
|---|---|---|---|---|---|---|---|
| | | THICKNESS OF SURFACE LAYER | | | | | |
| | | 50 um | | | 70 um | | |
| | | KINDS OF PAPER SHEET | | | | | |
| | | 20lb PAPER SHEET | 127 g/m PAPER SHEET | ENVE-LOPE | 20lb PAPER SHEET | 127 g/m PAPER SHEET | ENVE-LOPE |
| 54.9 N | 40° | 84% | 77% | 77% | — | — | — |
| | 50° | — | — | — | — | — | — |
| | 52° | — | — | — | — | — | — |
| 72.5 N | 40° | 92% | 84% | 85% | 87% | 84% | 75% |
| | 50° | 87% | 81% | 78% | 81% | 79% | 75% |
| | 52° | — | — | — | — | — | — |
| 81.3 N | 40° | 90% | 92% | 93% | 90% | 89% | 91% |
| | 50° | 84% | 81% | 86% | 82% | 79% | 81% |
| | 52° | — | — | — | — | — | — |

IMAGE-FORMING APPARATUS WITH A FIXING DEVICE FOR FIXING A TONER IMAGE ON A SHEET-LIKE MATERIAL

BACKGROUND OF THE INVENTION

1. Field of the Invention

The present invention relates to an image-forming apparatus for forming a toner image on a sheet-like material. More specifically, the invention relates to an image-forming apparatus having a fixing device which fixes the toner image on the sheet-like material and is equipped with a heated roller for fusing the toner image and a pressure roller for pressing the sheet-like material against the heated roller.

2. Description of the Related Art

A heated roller type fixing device has been widely applied to electro-photographic image-forming devices in recent years because it has the feature of ensuring stable image fixing in spite of being small in construction.

The heated roller type fixing device is equipped with a heated roller and a pressure roller, and fixes a toner image on a paper sheet by heating and fusing when the paper sheet passes between the heated roller and the pressure roller. Furthermore, the heated roller is capable of housing a heating lamp as a heat source, and the roller surface is coated with a material that is easily separated from the toner image. Heated roller type fixing devices require a long service life for the heated roller.

As one structure proposed to meet this requirement, a heated roller which has a fluorine resin layer on the surface is disclosed in Japanese Patent Publication (Koukoku) No. 3-14350. The fluorine resin layer is formed from a tube made from a copolymer of perfluoroalkyl perfluorovinyl ether. After the tube is applied around the outer surface of the metallic cylinder which is coated with a bonding agent, the fluorine resin is thermally shrunk at a high temperature, to produce the fluorine resin layer.

However, the heated roller having the fluorine resin layer is not commercially acceptable in relation to the fixing performance.

SUMMARY OF THE INVENTION

It is therefore an object of the present invention to provide an improved fixing unit for an image-forming apparatus.

It is a particular object of the invention to provide a fixing unit which has a long-life heated roller and good fixing performance.

A further object of the invention resides in the provision of an image-forming apparatus having the improved fixing unit.

Another object of the invention is to provide an improved fixing method.

In accordance with one aspect of the present invention, the forgoing objects, among others, are achieved by providing a fixing device for utilization in fixing a toner image to a sheet-like material, having a heated roller for heating the sheet-like material with the toner image. The heated roller includes a surface layer comprising a heat-shrunk fluorine resin. A pressure roller is arranged in rolling contact with the heated roller, for pressing the sheet-like material against the heated roller. A member for providing at least one of the following conditions: a) a temperature at the surface of the heated roller of at least 200° C.; b) a pressure between the heated roller and the pressure roller of at least about 72.5N; c) a hardness of the surface of the pressure roller of at least about 40° (ASKER-C system); and d) an elastic surface layer on the pressure roller having a thickness of at most about 50 μm and which comprises a fluorine resin.

In accordance with another aspect of the present invention, there has been provided an image-forming apparatus for forming an image on a sheet-like material, having an image-forming unit for forming a toner image on the sheet-like material, and a heated roller for heating the sheet-like material with the toner image. The heated roller includes a surface layer comprising a heat-shrunk fluorine resin. A pressure roller is arranged in rolling contact with the heated roller, for pressing the sheet-like material against the heated roller. A member for providing at least one of the following conditions: a) temperature at the surface of the heated roller of at least 200° C.; b) a pressure between the heated roller and the pressure roller of at least about 72.5N; c) a hardness of the surface of the pressure roller of at least about 40° (ASKER-C system); and d) an elastic surface layer on the pressure roller having a thickness of at most about 50 μm and which comprises a fluorine resin.

In accordance with still another aspect of the present invention, there has been provided a fixing method for fixing a toner image to a sheet-like material, having steps of heating a surface of a heated roller so that the surface temperature is at least about 200° C., the heated roller including a surface layer comprises a heat-shrunk fluorine resin; pressing a pressure roller against the heated roller to form a nip portion at which the pressure between the heated roller and the pressure roller is at least about 72.5N, the surface hardness of the pressure roller being at most about 40° (ASKER-C system), and the pressure roller includes an elastic surface layer whose thickness is at most about 50 μm and which comprises a fluorine resin; driving the heated roller and the pressure roller to pass the sheet-like material with the toner image through the nip portion between the heated roller and the pressure roller.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein:

FIG. 5 is a table showing the result of investigations regarding optimum conditions for improving the fixing properties of a fixing unit used in the laser printer of FIG. 1 when the surface temperature is 190° C.;

FIG. 6 is a table showing the result of investigations regarding optimum conditions for improving the fixing properties of a fixing unit used in the laser printer of FIG. 1 when the surface temperature is 200° C.;

FIG. 1 is a graph showing the relationship between the surface temperature of the heated roller and S/N ratios in FIG. 5;

FIG. 1 is a graph showing the relationship between pressure applied to the heated roller and S/N ratios in FIG. 6;

FIG. 1 is a graph showing the relationship between the thickness of the surface layer of the pressure roller and S/N ratios in FIG. 6;

DETAILED DESCRIPTION OF THE PREFERRED EMBODIMENTS

Figure 1:
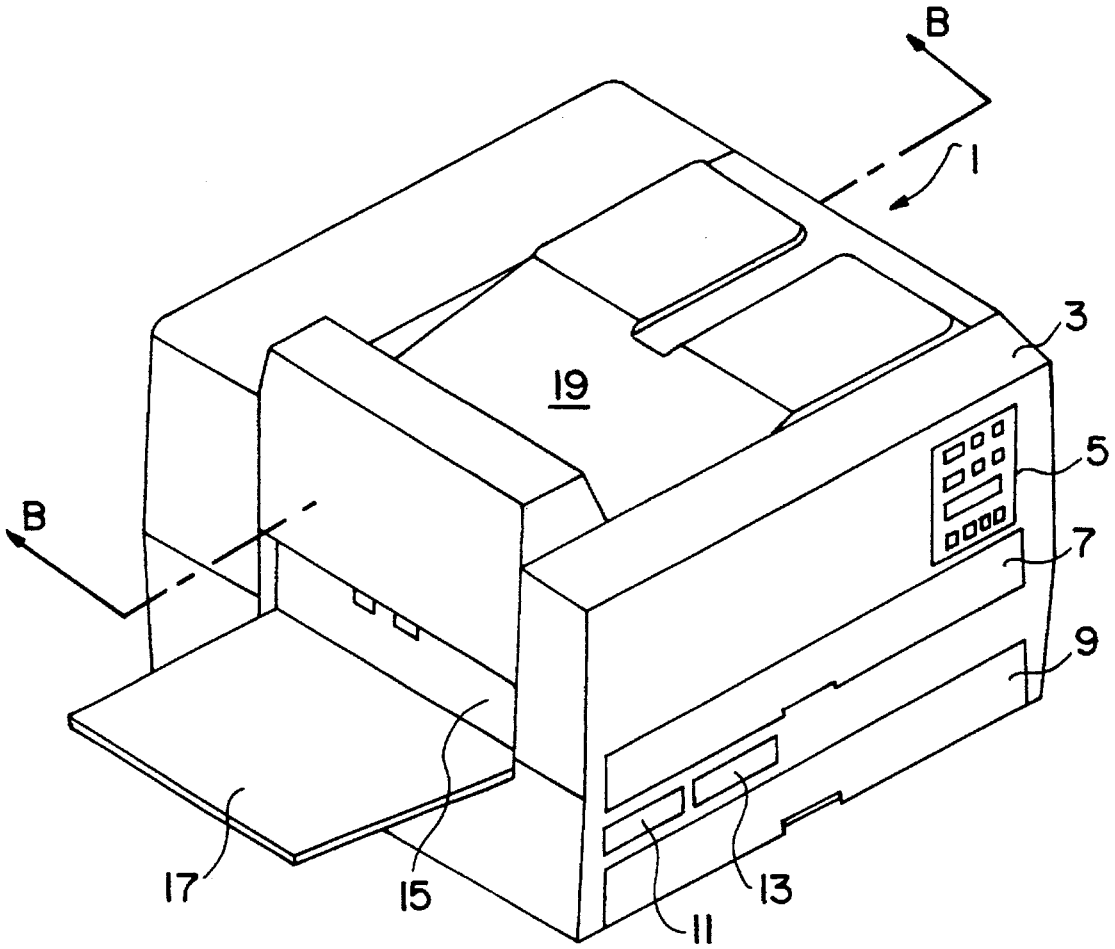
FIG. 1 is a perspective view showing the outer appearance of a laser printer.
Figure 2:
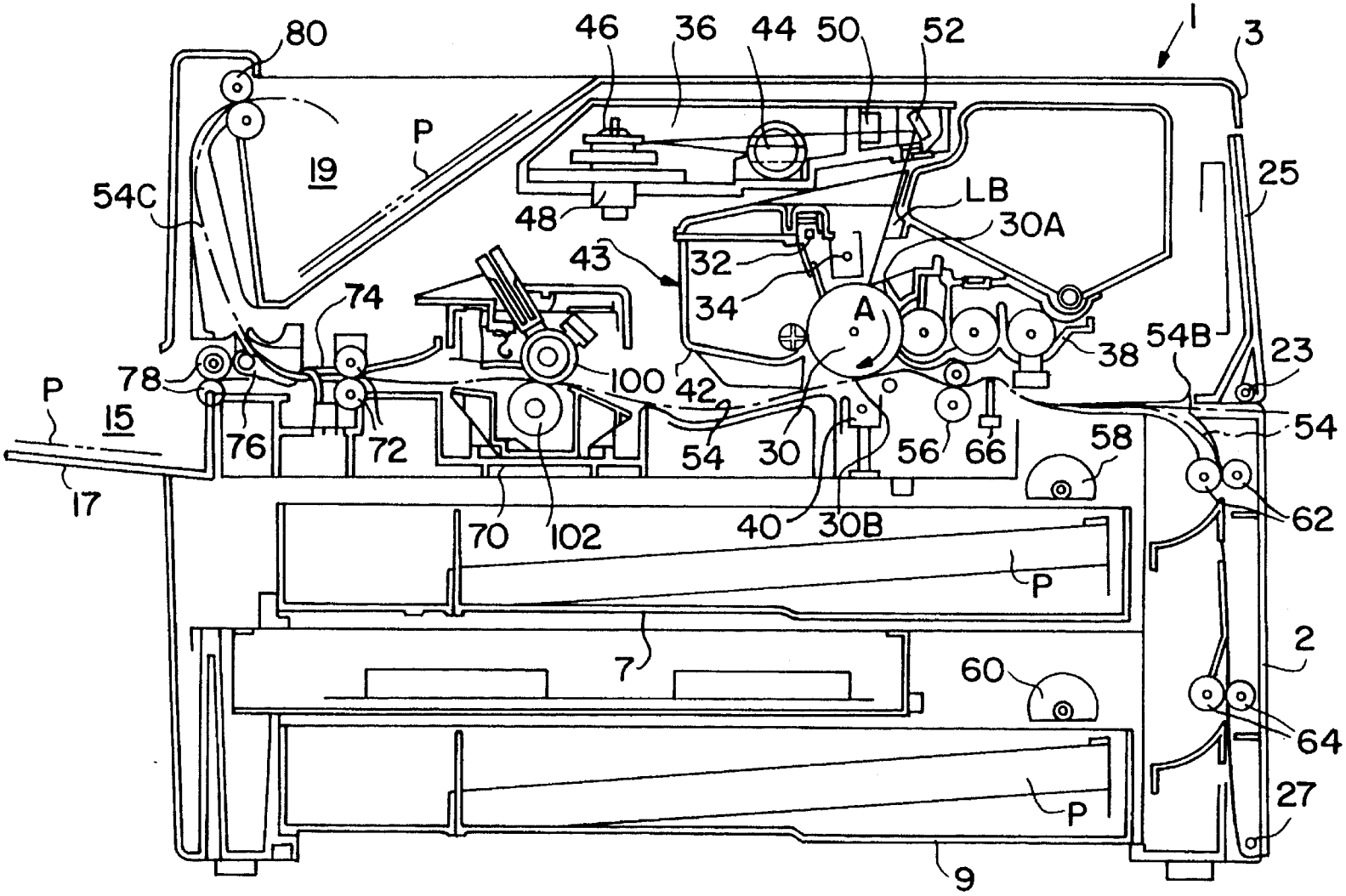
FIG. 2 is a sectional view along section line B—B in FIG. 1.

FIGS. 1 and 2 show a laser printer 1 as an example of an image-forming apparatus which incorporates a fixing device according to one embodiment of the present invention.

Laser printer 1 includes a housing 3 and an operating panel 5 arranged at the right front side of housing 3. A paper cassette 7 and a paper cassette 9, which are removable from housing 3, are mounted in the lower section of housing 3. An opening 11 and an opening 13 are provided between paper cassettes 7 and 9 for inserting font cards for adding functions, application software cards, and so on (not shown). A concave portion 15 is provided as a first paper sheet exit portion at the left side of housing 3. A tray 17 receives paper sheets discharged through concave portion 15. A concave portion 19 is formed on the top of housing 3. Concave portion 19 is a second paper sheet receiving portion.

As shown in FIG. 2, at the right side of housing 3, a manual paper supply guide 21 which opens to the outside is provided, which is mounted hingedly around a supporting shaft 23. A side cover 25 which opens to the outside is mounted for rotation around a supporting shaft 27 provided on housing 3, at the lower section of manual paper supply guide 21.

A photosensitive drum 30 is located substantially in the center of housing 3 so as to be rotatable in the direction of arrow A. Photosensitive drum 30 is formed of a photoconductive material based on an organic photoconductor (OPC). Photosensitive drum 3 is surrounded by a red LED 32 for use as a de-electrifier having the function mentioned later, a scorotron charger 34 for charging the surface of photosensitive drum 30, a laser unit 36 for use as an electrostatic latent image-forming means, a developing device, a transfer charger 40, and a cleaner 42, which are successively arranged in the rotating direction of photosensitive drum 30. These components constitute image-forming unit 43 for forming a toner image as a developer image on the circumferential surface of photosensitive drum 30.

Laser unit 36 radiates a laser beam LB onto the charged surface of photosensitive drum 30 to form an electrostatic latent image. Laser unit 36 includes a semiconductor laser oscillator (not shown in detail) for generating laser beam LB modulated in accordance with dot image data sent by a host unit, e.g., a computer or a wordprocessor. The semiconductor laser oscillator is located in a laser generating unit 44. Laser generating unit 44 also includes a collimator lens for focusing laser beam LB generated from the laser oscillator so that the cross-sectional shape of laser beam LB is circular. Laser beam LB passed through the collimator lens reaches a polygon mirror 46 for scanning laser beam LB. At that time, polygon mirror 46 is rotated at high speed by a mirror motor 48. Then laser beam LB reaches an fΘ lens 50 so as to unify the focusing condition in the scanning direction, and sequentially reaches a mirror 52 for reflecting laser beam LB. Finally, laser beam LB reaches an exposure portion 30A of photosensitive drum 30.

A paper transport path 54 is defined in housing 3. Paper transport path 54 is used to guide a paper sheet P as a transfer medium, taken out of paper cassette 7 or paper cassette 9, to tray 17 or concave portion 19 through an image transfer section 30B between photosensitive drum 30 and transfer charger 40.

An aligning roller pair 56 is arranged on the upstream side of paper transport path 54 with respect to image transfer section 30B. Aligning roller pair 56 aligns the leading edge of a paper sheet P, taken out of paper cassette 7 or 9 by means of paper supply roller 58 or paper supply roller 60, paper transporting roller pair 62 or paper transporting roller pair 64, through a paper transport path 54A. Also, aligning roller pair 56 can receive a paper sheet P from manual paper supply guide 21 through paper transport path 54B. An aligning switch 66 detects a paper sheet P transported to aligning roller pair 56 upstream of transfer section 30B. After aligning roller pair 56 receives a paper sheet P, aligning roller pair 56 timely feeds the paper sheet P into transfer section 30B.

A fixing unit 70 and a paper transporting roller 72 are arranged on the downstream side of transfer section 30B. Fixing unit 70, as described in detail later, fixes the toner image transferred onto paper sheet P.

An exit switch 74 for detecting a paper sheet P which is discharged, and a gate 76 are located on the downstream portion of transporting roller pair 72. Gate 76 selectively guides a paper sheet P to tray 17 or alternatively concave portion 19. A discharge roller pair 78 discharges paper sheet P to tray 17 when gate 76 guides the paper sheet P to tray 17. A discharge roller pair 78 discharges paper sheet P to concave portion 19 through transport path 54C when gate 76 guides the paper sheet P to concave portion 19.

The image-forming operation of laser printer 1 constructed in this manner will be described.

First, photosensitive drum 30 is rotated in the direction of arrow A, and the circumferential surface of photosensitive drum 30 is negatively charged in a substantially uniform manner by means of scorotron charger 34. Then, a laser beam LB from laser unit 36 is applied onto the charged region to expose it in exposure portion 30A, in accordance with image information to be recorded. As a result, an electrostatic latent image is formed on the circumferential surface of photosensitive drum 30. As photosensitive drum 30 rotates, the latent image faces developing device 38. Developing device 38 adheres toner whose average particle diameter is from about 6 μm to 15 μm to the exposed portion of the circumferential surface of photosensitive drum 30, so that the toner image is subjected to so-called reversal development. The developed toner image is transported to transfer section 30B. Toner T is composed of resin and carbon.

In the meantime, a paper sheet P, taken out from paper cassette 7, paper cassette 9, or manual paper supply guide 21 is delivered to transfer section 30B by means of aligning roller pair 56 in synchronism with the rotation of photosensitive drum 30. The back of delivered paper sheet P is charged to a positive polarity by means of transfer charger 40. Thus, the developed toner image on the surface of photosensitive drum 30 is electrostatically attracted and transferred to paper sheet P.

After the transfer process, paper sheet P is delivered to fixing unit 70, whereupon the toner T is melted and fixed to paper sheet P. After that, paper sheet P is discharged to tray 17 or concave portion 19. When laser printer 1 starts the image-forming operation, the destination of paper sheet P has been determined to be tray 17 or concave portion 19 by a signal from the host apparatus. Thus, gate 76 is positioned corresponding to the destination prior to the image-forming operation.

The construction of fixing unit 70 will now be described in detail, with reference to FIGS. 3 and 4.

Fixing unit 70 includes a heated roller 100 positioned at the top side of paper transport path 54 and a pressure roller 102 which is kept in contact with heated roller 100 by pressure from a pressure mechanism positioned at the bottom surface side of paper transport path 54. The pressure mechanism includes a lever 104 and a spring 106. One end of lever 104 is rotatably supported by a shaft 108 fixed on a part of fixing unit 70. The other end of lever 104 is connected to one end of spring 106. The other end of spring 106 is fixed on a part of fixing unit 70. Spring 106 applies pressure to lever 104 in the direction of arrow PR. The middle portion of lever 104 rotatably supports pressure roller 102. Lever 104 has two portions located along the direction of the rotational axis of pressure roller 102. Thus, heated roller 100 and pressure roller 102 are forced under pressure against each other. Pressure roller 102 applies a pressure of about 75.0N against heated roller 100.

Heated roller 100 includes, in the inside, a heater lamp 110 which is a heat source. Heated roller 100, whose diameter in one preferred embodiment is about 24 mm, includes a metallic cylinder 100A and a surface layer 100B which is preferably made from a copolymer of perfluoroalkyl perfluorovinyl ether with tetrafluoroethylene. The surface layer preferably has a thickness of about 30 μm, formed on metallic cylinder 100A. Pressure roller 102, whose diameter in one preferred embodiment is about 28 mm, includes a foamed silicon rubber layer 102A and a surface layer 102B which is also preferably made from a copolymer of perfluoroalkyl perfluorovinyl ether with tetrafluoroethylene. Foamed silicone rubber layer 102A is preferably about 8 mm in thickness. The layer 102B is preferably about 50 μm in thickness and is formed on foamed silicon rubber layer 102A. The rubber hardness of pressure roller 102 is at about 35°. The copolymer of perfluoroalkyl perfluorovinyl ether with tetrafluoroethylene represents one kind of preferred polytetrafluoroethylene. It is highly preferred that each of surface layer 100B and surface layer 102B be made from a fluorine resin, such as polytetrafluoroethylene.

Heated roller 100 rotates in the direction of arrow C, and pressure roller 102 rotates in the direction of arrow D. Thus, when a paper sheet P passes through the nip portion between heated roller 100 and pressure roller 102, the transferred toner image is melted by heat and fixed. The surface temperature of heated roller 100 is adjusted to about 200° C. by a temperature control system (not shown).

Heated roller 100 and pressure roller 102 are enclosed by an upper casing 112 and a lower casing 114 to prevent heat from radiating to the outside, to the extent possible in order to secure a satisfactory temperature atmosphere needed for the toner image fixing. A fuser guide (not shown) is provided on the top of upper casing 112 to lower it for preventing burn and so on.

An inlet guide 116 and an inlet guide 118 are arranged in the vicinity of the upstream side of the nip portion and at the inlet side of fixing unit 70 to guide the leading edge of paper sheet P with the toner image to the nip portion.

Figure 3:
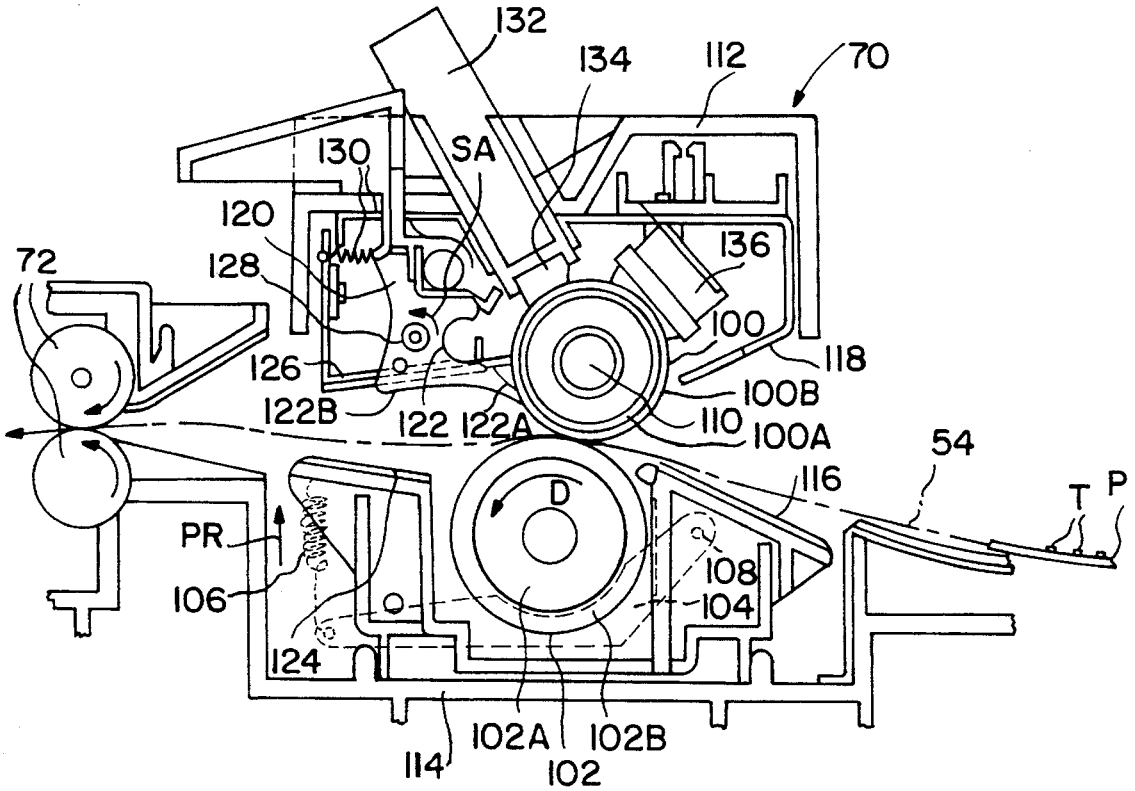
FIG. 3 is an enlarged view of a portion of the sectional view in FIG. 2, showing the arrangement of the laser printer of FIG. 1.

A separation mechanism 120 equipped with a plurality of separation claws 122 (only one claw is seen in FIG. 3), an outlet guide 124, and an outlet guide 126 are arranged in the vicinity of the downstream of the nip portion and at the outlet side of fixing unit 70. Separation mechanism 120 separates any paper sheet P which is wound around heated roller 100. Outlet guide 124 and outlet guide 126 guide a fixed paper sheet P to transporting roller pair 72.

Separation mechanism 120 has a shaft 128 extending parallel with heated roller 100. Separation claws 122 are mounted to shaft 128 at prescribed intervals in the freely rotate state. Also, separation mechanism 120 has springs 130. Each spring 130 is connected to one separation claw 122. Separation claws 122 are forced to always rotate in the direction of arrow SA by springs 130, and the claw end portions 122A of separation claws 122 are pressed against heated roller 100 under a prescribed force.

The bottom surface of each separation claw 122 is a guide surface 122B, to guide the separated paper sheet P. Therefore, each separation claw 122 also serves as a guide.

Fixing unit 70 includes a cleaning member 132 located above separation mechanism 120. Cleaning member 132 has a cleaning felt 134 which is a cleaning material and removes toner T, paper powder, etc., adhered to the surface of heated roller 100. Cleaning member 132 is arranged so that cleaning felt 134 is in contact with heated roller 100.

A thermistor 136, which is a temperature sensor, is arranged at the downstream (in the rotational direction C) side of heated roller 100 from the arranged position of cleaning member 132. Thermistor 136 is in contact with heated roller 100 to detect the surface temperature of heated roller 100 in order to keep it at a temperature required for the fixing. As described above, the temperature is about 200° C. in this embodiment. On the other hand, the softing point of toner T is from about 100° C. to 120° C.

Gears (not shown) which engage each other are mounted at one end side of heated roller 100 and that of pressure roller 102. When fixing unit 70 is incorporated in housing 3 of laser printer 1, these gears are engaged with each other to receive a driving force. Heated roller 100 and pressure roller 102 rotate at a predetermined speed at which seventeen paper sheets P are transported per one minute in the direction of arrows C and D, as described above, by the driving force.

Figure 4A:
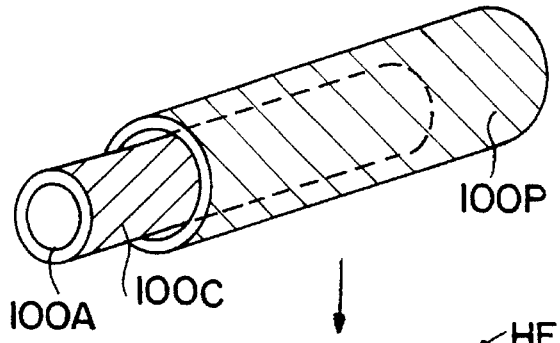
FIGS. 4(*a*) to 4(*c*) represent a flow chart showing a method for manufacturing the heated roller used in the laser printer of FIG. 1.
Figure 4B:
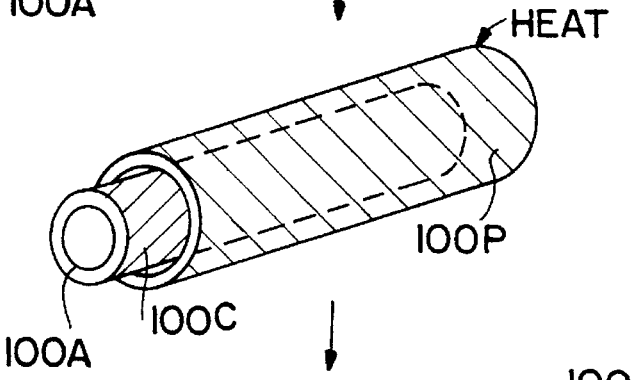
Figure 4C:
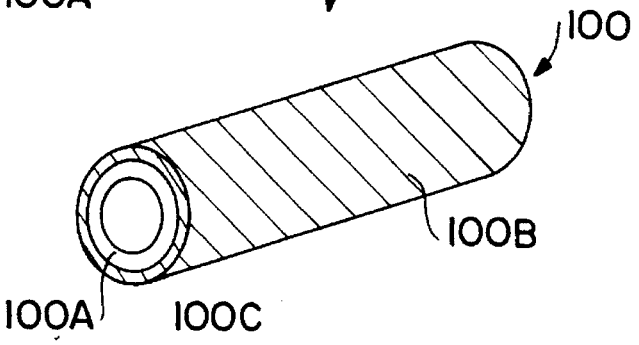
Figure 7:
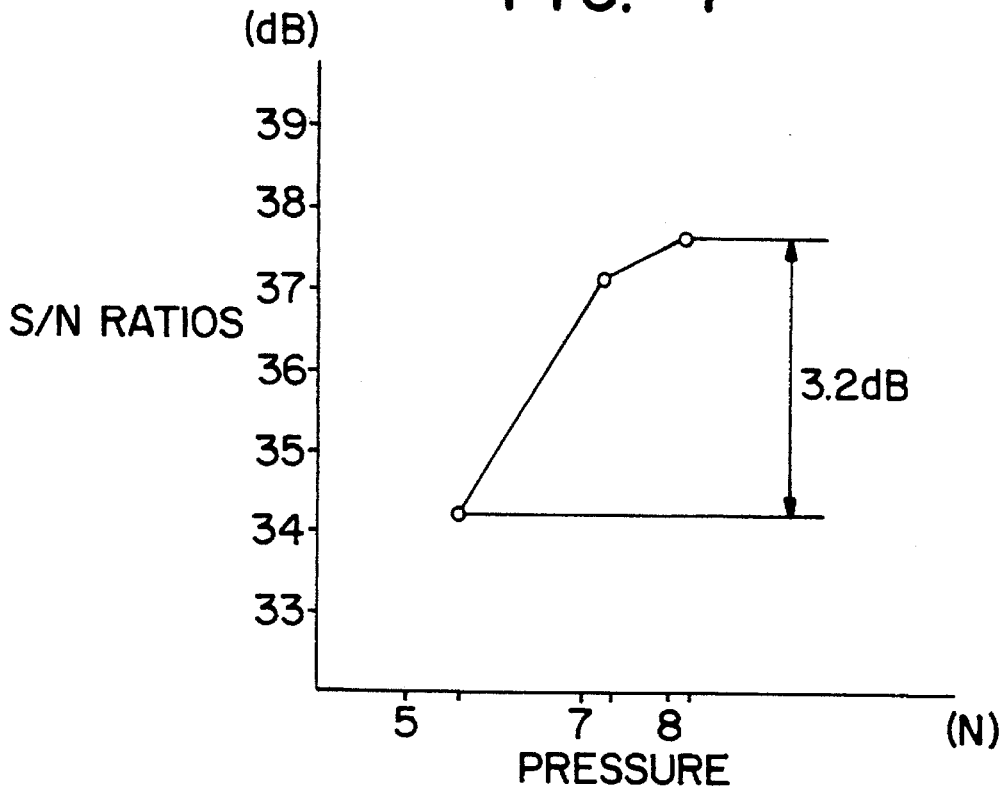
FIG. 7 is a graph showing the relationship between pressure applied to the heated roller and S/N ratios in FIG. 5.
Figure 8:
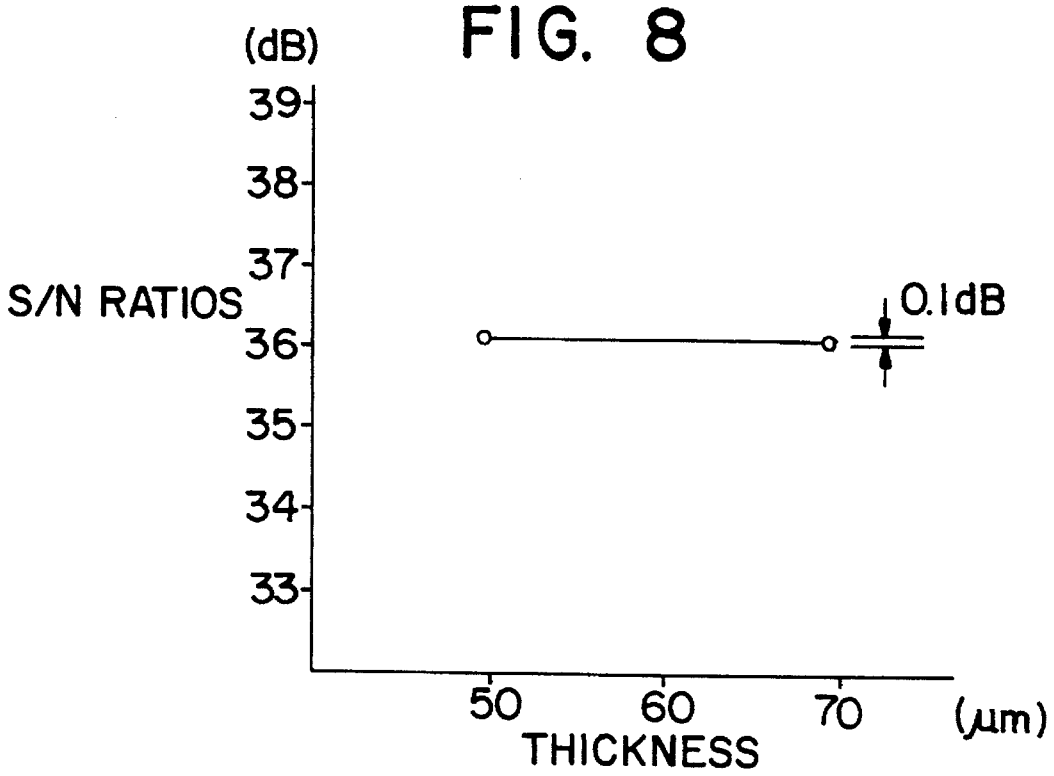
FIG. 8 is a graph showing the relationship between the thickness of the surface layer of the pressure roller and S/N ratios in FIG. 5.
Figure 9:
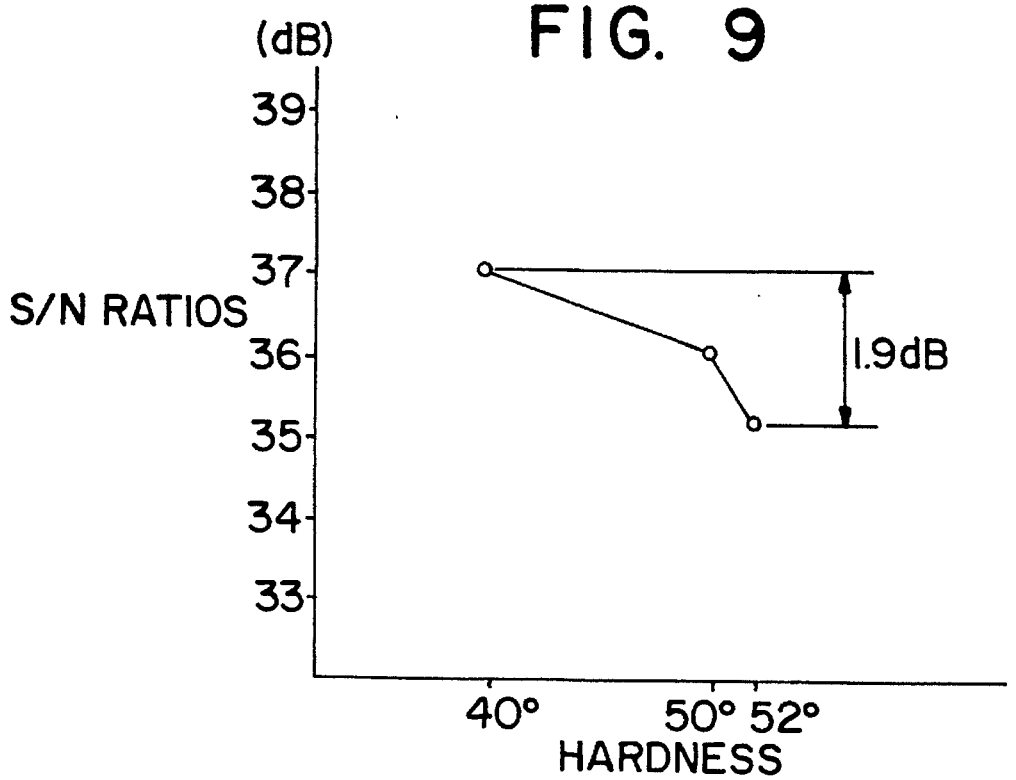
FIG. 9 is a graph showing the relationship between the hardness of the pressure roller and S/N ratios in FIG. 5.
Figure 10:
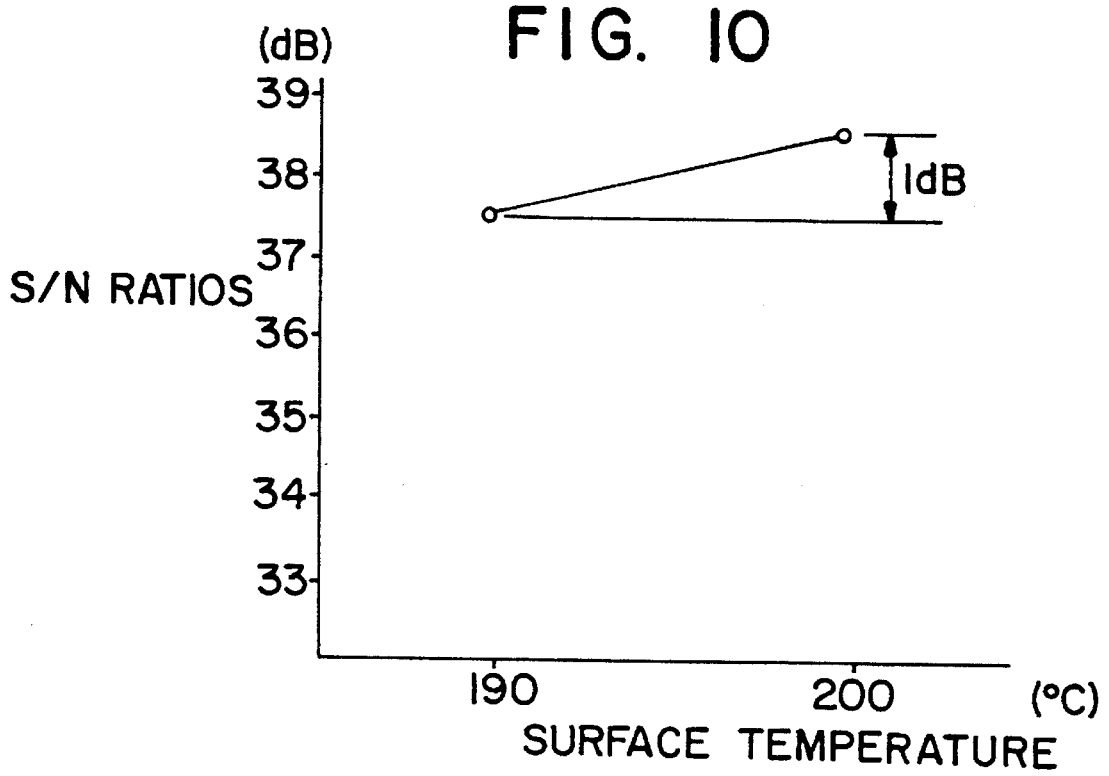
Figure 11:
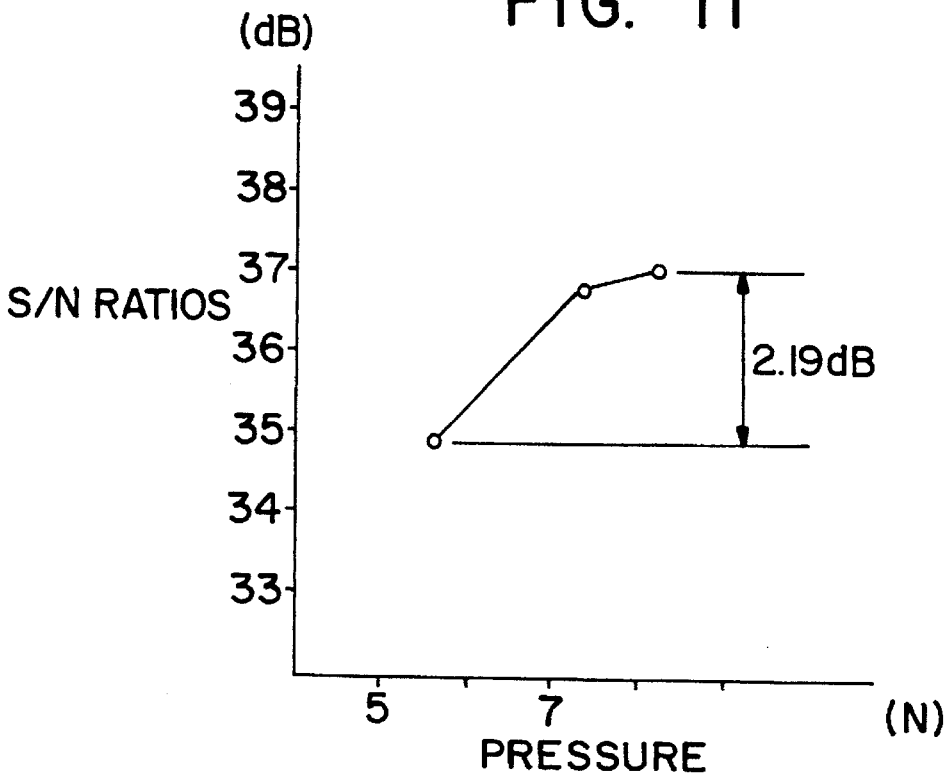

Heated roller 100 is preferably manufactured as illustrated in FIGS. 4(*a*) to 4(*c*).

First, a tube 100P made from a copolymer of perfluoroalkyl perfluorovinyl ether, which will form surface layer 100B, is put over metallic cylinder 100A made preferably of aluminum as shown in FIG. 4(*a*). The tube 100P in a preferred embodiment is 24 mm in diameter and 1 mm in thickness. The outer surface of metallic cylinder 100B has applied thereto a bonding agent 100C in advance, for bonding tube 100P.

Then, tube 100P is thermally shrunk in a furnace kept at a high temperature as shown in FIG. 4(*b*).

Finally, heated roller 100 with surface layer 100B put on metallic cylinder 100A results, as shown in FIG. 4(*b*).

The hardness of surface layer 100B manufactured in this manner has a value H, as a result of a pencil scratching test (JIS K5400), and the smoothness is about 1 μm at Rz.

When heated roller 100 covered by surface layer 100B is used in fixing unit 70, it is revealed that the life of heated roller 100 amounts to more than 300,000 paper sheets. Also, the fixing property is good. In other words, toner T is hardly separated when printed paper sheet P is touched by hand, whereby the hand is not soiled and the image on printed paper sheet P is not removed. It would not be satisfactory merely to use this type heated roller 100. For example, in case of a conventional type heated roller on which polytetrafluoroethylene particles are centered on the surface, a fixing rate (i.e., an image density ratio before and after a printed image is rubbed with an eraser, felt, etc. of 100% means that the toner on a paper sheet was not separated at all, while a fixing rate of 0% means that toner on the paper sheet was completely separated) at an environmental condition of 10° C. using a 20 lb. ordinary paper sheet was 80–90%, while it was only 40–50% in case of heated roller 100 in the same condition. In other words, the fixing condition, for example, the pressure on heated roller 100, the surface temperature of heated roller 100, the thickness of each of surface layers 100B and 102B, the hardness of pressure roller 102, and so on, is very important. In case of fixing unit 70, the fixing condition is good. Thus, the fixing property is good.

In view of the above, the inventors have performed tests, as shown in FIGS. 5 and 6, in order to find out the range of the various conditions in relationship to the fixing property of fixing unit 70 in order to provide commercially acceptable results.

FIG. 5 shows fixing rates at a surface temperature of 190° C. for heated roller 100, and FIG. 6 shows the same at a surface temperature of 200° C. FIGS. 7 through 14 are graphs plotted based on the data shown in FIGS. 5 and 6, by the S/N ratio of the quality control technique.

FIGS. 7 through 10 show the fixing properties by S/N ratios on 20 lb. paper sheet and 127 g/m$^2$ paper sheet. In these graphs, the larger the S/N ratios the better. In FIGS. 5 through 8, the pressure shown in FIG. 5 had the greatest effect. However, there was not so large a difference between 72.5N (7.4 kgf) and 81.3N (8.3 kgf). Also, the surface temperature had a large effect. According to FIG. 9, further, the lower the hardness (ASKER-C system) of pressure roller 102, the better the fixing property was.

Figure 12:
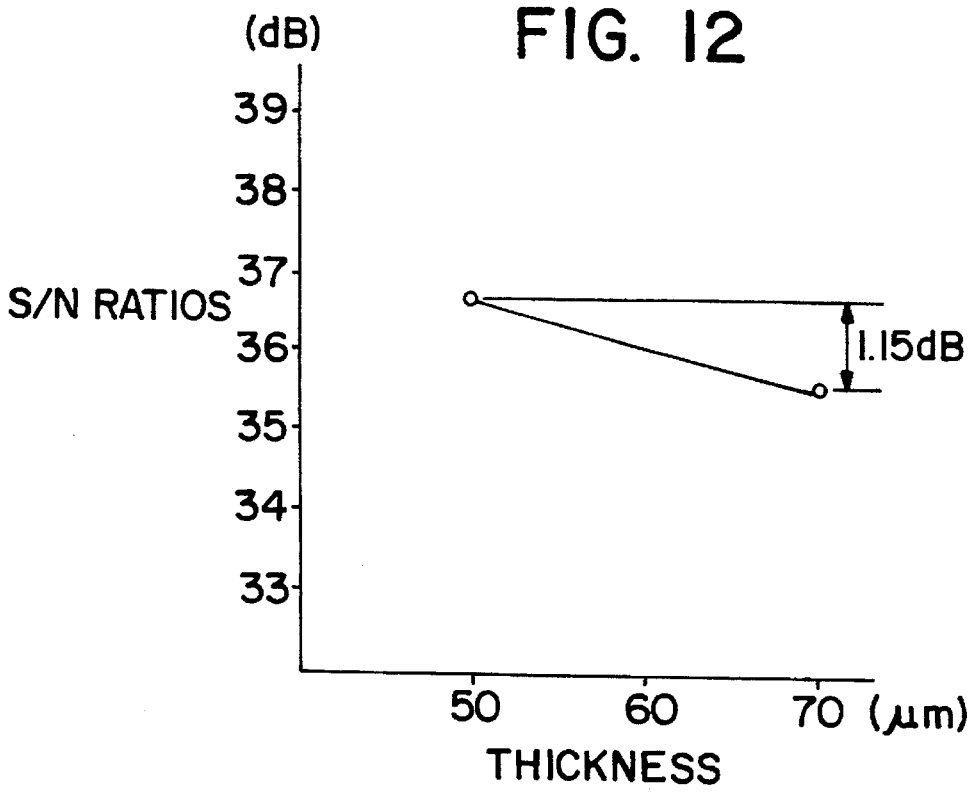
Figure 13:
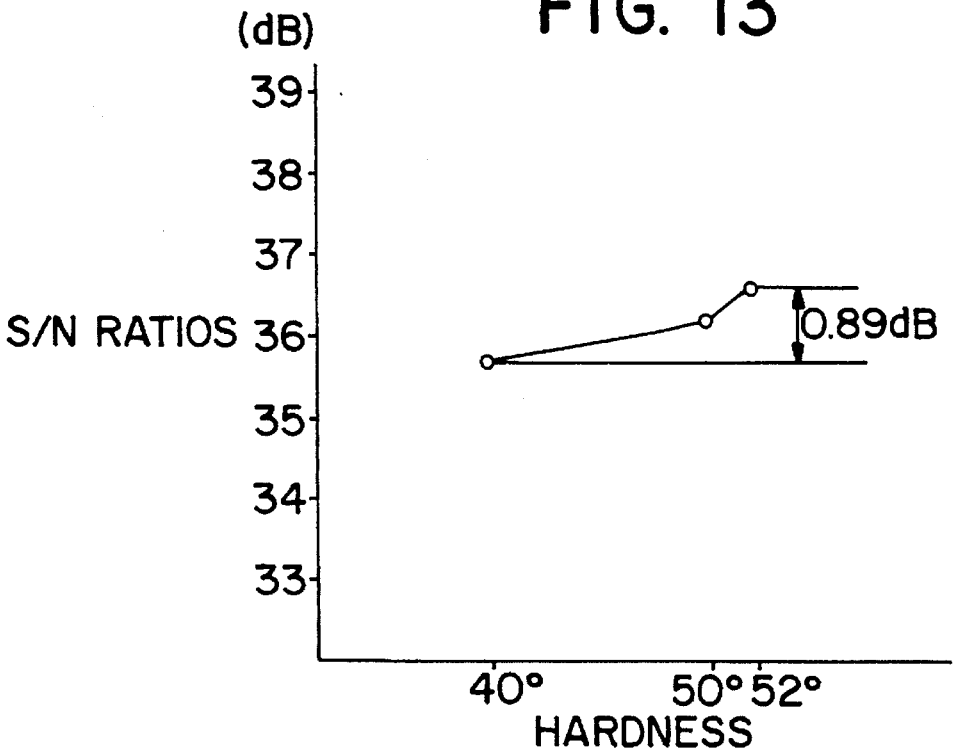
FIG. 13 is a graph showing the relationship between the hardness of the pressure roller and S/N ratios in FIG. 6.
Figure 14:
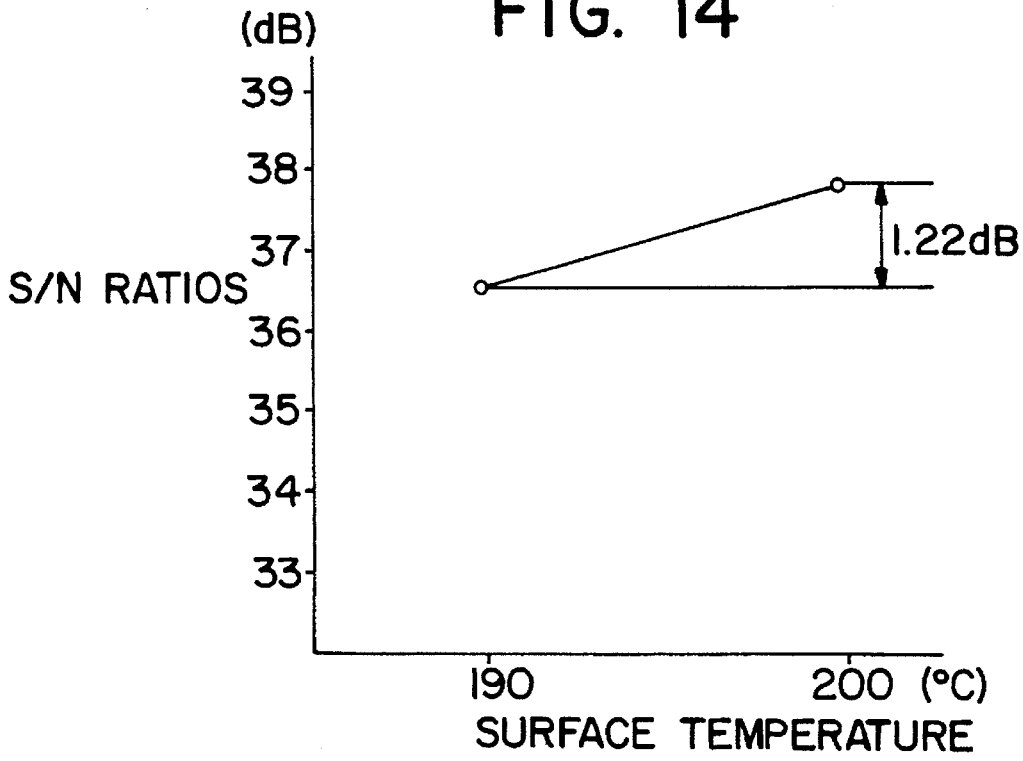
FIG. 14 is a graph showing the relationship between the surface temperature of the heated roller and S/N ratios in FIG. 6.

FIGS. 11 through 14 show the fixing properties by S/N ratios for a typical mailing envelope. In these graphs, the larger the S/N ratio the better. In FIGS. 11 through 14, higher hardness of pressure roller 102 was better, as shown in FIG. 13. Further, the result was shown that the fixing properties will become poorer if the thickness of surface layer 102B is increased, as shown in FIG. 12.

According to the analysis described above, it was revealed that the optimum pressure between heated roller 100 and pressure roller 102 is about 72.5N (7.4 kgf) or more, the optimum surface temperature of heated roller 100 is about 200° C. or more, the optimum hardness of pressure roller 102 is about 40° or less (ASKER-C system), and the optimum thickness of surface layer 102B is about 50 μm or less. If any one of these conditions is set as described above, a practically usable fixing effect can be obtained, and when several or all of the conditions are combined, a more commercially advantageous fixing effect can be obtained.

Further, for separation claws 122 of fixing unit 70, if the surface temperature of heated roller 100 is at about 190° C., separation claws made of PPS (polyphenylene sulfate resin) are also usable. The PPS claws have a long useful life at temperatures of about 200° C. If the surface temperature is above 200° C. unless separation claws made of more heat-resistant material, for instance, polyamide-imide resin (long use life temperature about 250° C.) or polyimide resin (long use life temperature about 300° C. through 360° C.) is used, the separation claws may deteriorate and their ends tend to chip or break as a matter of course. Therefore, a material that has a long useful life at a higher temperature than the fixing temperature should be selected for the separation claws.

The present invention may be embodied in other specific forms without departing from the spirit or essential characteristics thereof. The presently described embodiments are therefore to be considered in all respects as illustrative and not restrictive. The scope of the present invention is indicated by the appended claims rather than by the foregoing description, and all changes which come within the meaning and range of equivalency of the claims are therefore intended to be embraced therein.

What is claimed is:

1. A fixing device, comprising:

a heated roller for heating a sheet-like material with a toner image, the heated roller including a surface layer comprising a heat-shrunk fluorine resin, the surface layer being arranged in a surface of the heated roller;

a pressure roller, arranged in rolling contact with the heated roller by a surface thereof, for pressing the sheet-like material against the heated roller; and means for providing at least one of following conditions:

a temperature at the surface of the heated roller of at least 200° C.:

b) a pressure between the heated roller and the pressure roller of at least about 72.5N;

c) a hardness of the surface of the pressure roller of at least about 40° C. (ASKER-C system); and d) an elastic surface layer on the presser roller having a thickness of at most about 50 μm and which comprises a fluorine resin, wherein one of the conditions is the pressure.

2. A fixing device according to claim 1, having at least two of the conditions, and wherein two of the conditions are the temperature and the pressure conditions.

3. A fixing device according to claim 1, having at least two of the conditions, and wherein two of the conditions are the pressure and the hardness conditions.

4. A fixing device according to claim 1, having at least two of the conditions, and wherein two of the conditions are the pressure and the elastic surface layer conditions.

5. A fixing device according to claim 1, having at least three of the conditions, and wherein three of the conditions are the temperature, the pressure and the hardness conditions.

6. A fixing device according to claim 1, having at least three of the conditions, and wherein three of the conditions are the temperature, the pressure and the elastic surface layer conditions.

7. A fixing device according to claim 1, having at least three of the conditions, and wherein three of the conditions are the pressure, the hardness and the elastic surface layer.

8. A fixing device according to claim 1, wherein four of the conditions of the conditions are present.

9. A fixing device according to claim 1, wherein the fluorine resin comprises polytetrafluoroethylene.

10. A fixing device according to claim 9, wherein the polytetrafluoroethylene comprises a copolymer of perfluoroalkyl perfluorovinyl ether with tetrafluoroethylene.

11. An image-forming apparatus, comprising an image-forming unit for forming a toner image on a sheet-like material;

a heated roller for heating the sheet-like material with the toner image, the heated roller including a surface layer comprising a heat-shrunk fluorine resin, the surface layer being arranged in a surface of the heated roller;

a pressure roller, arranged in rolling contact with the heated roller by a surface thereof, for pressing the sheet-like material against the heated roller; and means for providing at least one of following conditions:

a) a temperature at the surface of the heated roller of at least 200° C.;

b) a pressure between the heated roller and the pressure roller of at least about 72.5N;

c) a hardness of the surface of the pressure roller of at least about 40° C. (ASKER-C system); and d) an elastic surface layer on the pressure roller having a thickness of at most about 50 μm and which comprises a fluorine resin, wherein one of the conditions is the pressure.

12. An image-forming apparatus according to claim 11, wherein four of the conditions are presented.

13. An image-forming apparatus according to claim 11, having at least two of the conditions, two of the conditions being the temperature and the pressure conditions.

14. An image-forming apparatus according to claim 11, having at least two of the conditions, two of the conditions being the pressure and the hardness conditions.

15. An image-forming apparatus according to claim 11, having at least two of the conditions, two of the conditions being the pressure and the elastic surface layer conditions.

16. An image-forming apparatus according to claim 11, at least three of the conditions, three of the conditions being the temperature, the pressure and the hardness conditions.

17. An image-forming apparatus according to claim 11, at least three of the conditions, three of the conditions being the temperature, the pressure and the elastic surface layer conditions.

18. An image-forming apparatus according to claim 11, having at least three of the conditions, three of the conditions being the pressure, the hardness and the elastic surface layer conditions.

19. A fixing method, comprising steps of:

heating a surface of a heated roller so that a temperature of the surface thereof is at least about 200° C., the heated roller including a surface layer comprising a heat-shrunk fluorine resin;

pressing a surface of a pressure roller against the heated roller to form a nip portion at which a pressure between the heated roller and the pressure roller is at least about 72.5N, the hardness of the surface of the pressure roller being at most about 40° (ASKER-C system), and the pressure roller including an elastic surface layer whose thickness is at most about 50 μm and which comprises a fluorine resin; and driving the heated roller and the pressure roller to pass a sheet-like material with a toner image through the nip portion between the heated roller and the pressure roller.

* * * * *